United States Patent [19]

Halverson

[11] Patent Number: 4,732,395

[45] Date of Patent: Mar. 22, 1988

[54] FREE STANDING SPORT NET STAND

[76] Inventor: James E. Halverson, Box 80, Hillsdale, Wis. 54744

[21] Appl. No.: 61,120

[22] Filed: Jun. 10, 1987

[51] Int. Cl.[4] ..... A63B 61/02

[52] U.S. Cl. ..... 273/411; 273/29 BB

[58] Field of Search ..... 273/411, 29 B, 29 BB

[56] References Cited

U.S. PATENT DOCUMENTS

| | | | |
|---|---|---|---|
| D. 289,540 | 4/1987 | Bender | D21/199 |
| 3,399,889 | 9/1968 | Harry | 273/411 X |
| 4,135,716 | 1/1979 | Ginsburg | 273/411 X |
| 4,415,163 | 11/1983 | Schoenig | 273/411 |

*Primary Examiner*—William H. Grieb

*Attorney, Agent, or Firm*—Merchant, Gould, Smith, Edell, Welter & Schmidt

[57] ABSTRACT

A free standing sport net stand (10) is disclosed and has a foot member (12) on which a riser (15) and extension member (20) are cooperatively connected in a generally upward direction. A leg (16) and weight assembly (17) are cooperatively connected to the foot member (12) in an outward direction and generally perpendicular to the riser (15) and extension member (20). The foot member (12) may be used in a first position for inside use and a second position for outside use. Chains (25 and 28) may be utilized to further support the riser (15) and extension member (20) to the weight assembly (17).

22 Claims, 3 Drawing Figures

FREE STANDING SPORT NET STAND

BACKGROUND OF THE INVENTION

1. Field of the Invention

This invention relates generally to a free standing volleyball net stand and more particularly to a free standing volleyball net stand which may be easily assembled and disassembled without tools and having a removable weight or optionally a weight which may be filled on site.

2. Description of the Prior Art

Sport net stands have typically been either fastened directly to the ground or fastened to anchoring devices which have been securely fastened to the ground. This enables the upright support members to withstand the tension pressures of the net that is positioned between the net stands. It is quite important to have the top of a net level for best enjoyment of a sport. In making the top of the net level, great pressure is placed on the stand, thereby necessitating the stand be firmly anchored in place. Such stands are relatively fixed in position and they are not easily moved from location to location.

Early attempts at making portable net stands have basically been unsuccessful. One such example is simply where a tire is filled with cement and an upright post is inserted in the cement while it is still wet. When the cement hardens, the upright is then encased in cement which may be rolled around from position to position. However, the weight of the cement is not sufficient to overcome the tensions of a net and it is quite difficult to obtain a level net.

One of the first successful attempts to overcome the shortcomings of the prior art devices is shown in U.S. Pat. No. Des. 289,540, issued to Amos Bender on Apr. 28, 1987.

While the stand disclosed in U.S. Pat. No. Des. 289,540 overcomes many of the problems associated with the prior art, that were several shortcomings and improvements which needed to be made to construct a more universal, versatile and easily transportable net stand. The present invention addresses these problems.

SUMMARY OF THE INVENTION

The invention includes a free standing sport net stand for supporting a net. The stand includes a foot member having first and second stub members cooperatively connected thereto. The stub members are generally perpendicular to the foot member and the first stub member is generally perpendicular to the second stub member, wherein when in a first position, the first stub member extends generally upward and the second stub member extends generally outward and when in a second position, the first stub member extends generally outward and the second stub member extends generally upward. A generally upwardly extending riser has first and second ends. The first end is cooperatively connected to one of the stub members. The riser has holes formed therein, whereby the net may be secured to the riser for playing a first sport. A leg member, having first and second ends, has its first end cooperatively connected to the other of the stub members. A weight assembly is cooperatively connected to the second end of the leg member. The foot member has claw members attached thereto. The claw members extend generally downward when the foot member is in the first position, thereby stabilizing the stand when outside and when the foot member is in the second position, the claws extend inward for inside use.

In one embodiment, the stand further comprises an extension member cooperatively connected to the second end of the riser and telescopes in to the riser. The extension member has holes formed therein for securing the net at various levels. The stand may also include an adjusting plate for locking the extension member in place at the proper height on the riser.

In still another embodiment, the weight assembly may comprise a pan having upwardly extending first flanges and a removable weight sized to fit on the pan.

DETAILED DESCRIPTION OF THE PREFERRED EMBODIMENT

Figures 1, 2:
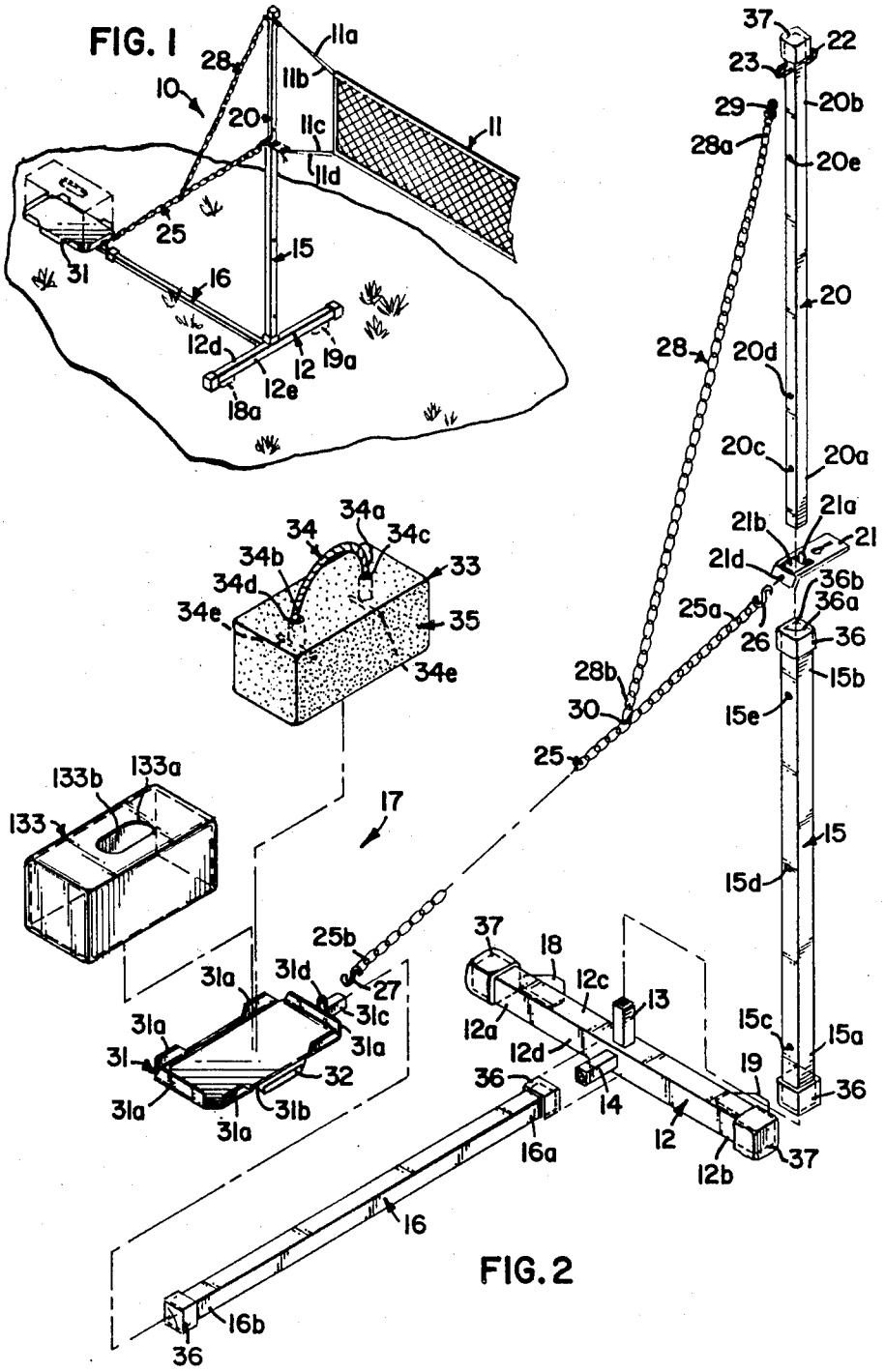
FIG. 1 is a perspective view of a portable net stand incorporating my present invention.
FIG. 2 is an exploded perspective view of the portable net stand of FIG. 1.

Referring to the drawing, wherein like numbers represent like parts throughout the several views, there is generally disclosed at 10, a free standing portable net stand. The stand 10 is utilized to support a net 11 at various heights. It is understood that typically two net stands 10 are utilized to support the net 11 at each end. However, only one of the net stands 10 will be described as the other stand is identical. Also, while FIG. 1 shows only a portion of the net 11, such a net is well known in the art and the net would continue, if shown, to be tied to a second stand at its other end. Alternately, only one stand could be utilized and that other side of the net 11 supported by another structure such as a tree. The net 11 may be of any suitable type. However, the net 11 will typically have two strings 11*a* and 11*b* extending from the top of the net 11 and two bottom strings 11*c* and 11*d* extending from the bottom of the net 11. The strings 11*a–d* are utilized to connect the net 11 to the stand 10. The stand 10 includes a foot member 12 having a first end 12*a* and a second end 12*b*. The foot 12 may be of any suitable material such as a one inch square tube and 30 inches in length. End caps 37 may be inserted over the ends 12*a* and 12*b*. The cap may be of any suitable material such as rubber or plastic. A first stub 13 is cooperatively connected to a first side 12*c* and a second stub 14 is cooperatively connected to a second side 12*d* of the foot member 12. The stubs 13 and 14 may be connected by any suitable method such as welding. The first side 12*c* and second side 12*d* are adjacent sides of the foot member 12. Therefore, the first stub 13 is generally perpendicular to the second stub 14. The stub 13 is generally perpendicular to the first side 12*c* and the stub 14 is generally perpendicular to the second side 12*d*. Claw member 18 is cooperatively connected to the foot member 12 adjacent the first end 12*a* and claw 19 is cooperatively connected to the foot member 12 adjacent the second end 12*b*. The claws 18 and 19 may be suitably connected by any method, such as welding. Referring to FIG. 1, the back side 18*a* of claw 18 and the backside 19*a* of claw 19 are co-planar with the third side 12*e* of the foot member 12. Such a construction allows for the foot member 12 to be used in two positions. The first position is shown in FIG. 2 and the second position is shown in FIG. 1. In the first position, the first stub member 13 extends generally upward and the second stub member 14 extends generally outward. When in the second position, the first stub member 13 extends generally outward and the second stub member 14 extends generally upward. When in the second position, the claw members 18 and 19 extend generally downward, thereby stabilizing the stand 10 when it is used outside. The claw members 18 and 19, by extending downward, are able to enter into the ground and thereby further stabilize the stand 10. When the foot member 12 is in the first position, the claws 18 and 19 extend inward for use inside. The bottom of the claw members 18 and 19 are co-planar with the third side 12*e*, thereby allowing the foot member 12 to rest fully on an indoor surface and be supported by not only the third side 12*e*, but also the bottoms 18*a* and 19*a* of the claw members 18 and 19.

A riser 15 has a first end 15*a* and a second end 15*b* and extends generally upward and is cooperatively connected to the first stub 13 when the foot member 12 is in a first position or to the second stub 14 when the foot member 12 is in the second position. The stubs 13 and 14 may be of any suitable material such as a ¾ inch square steel tube approximately 4 inches in length and welded to the foot member 12. When the stub members 13 and 14 are ¾ inch square tubes, the riser 15 would be a 1 inch square tube and 51 inches long. The inside dimension of the tube of the riser 15 would be sized to be slid over the stub members 13 and 14. A hole 15*c* is drilled 6½ inches from the bottom of the riser and a hole 15*e* is formed 6½ inches from the second end of the riser 15. A hole 15*d* is formed in the center of the riser. Not shown, are holes on the opposite side of the riser which are spaced equal to the holes shown. A cap of suitable material, such as plastic, is inserted over both ends of the riser 15. The cap 36 has two slits 36*a* and 36*b* which intersect and thereby provide an opening in which the stub members 13 or 14 may be inserted. Before insertion onto the square riser 15, the caps are circular. When they are inserted on the riser 15, they form to the square shape of the riser. As the smaller tubing (the stubs 13 and 14) are inserted into the cap, the pie section formed by the slits 36*a* and 36*b* fold between the two pieces of tubing, thereby making a good fit.

A weight assembly 17 is cooperatively connected to the foot member 12. In a preferred embodiment a leg 16 is positioned between the foot member 12 and weight assembly 17 to place the weight assembly 17 a distance further from the foot member 12. The leg 16 has a first end 16*a* and a second end 16*b*. The leg 16 may again be of any suitable material such as 1 inch square tubing having a length of 45 inches. Caps 36 are positioned over the ends 16*a* and 16*b* of the legs 16. The first end 16*a* is cooperatively connected to one of the stubs 13 or 14 by simply inserting the stub member into the leg 16. The leg 16 has an inner opening size to receive the stub members 13 or 14 and the cap 36 assures a good fit between the two. The first end 16*a* is cooperatively connected to the second stub 14 when the foot member 12 is in the first position or the first end 16*a* is cooperatively connected to the first stub 13 when in the second position.

The weight assembly 17 includes a pan 31 having upwardly extending flanges 31*a* around its perimeter. The pan 31 and flanges 31*a* form a receptacle for receiving the weight which may be placed on the pan 31. In FIG. 2, two embodiments of the weight are shown. The first is the weight 33 which includes a cement block 35. A handle 34, having first end 34*a* and second end 34*b* is inserted into the cement block while the cement is still soft. A plastic sleeve 34*c* is inserted over the first end 34*a* and a pin 34*e* driven through the first end 34*a*. Similarly, a sleeve 34*d* is placed over the second end 34*b* and a pin 34*e* is again placed through the second end 34*b*. The pins 34*e* help secure the handle in its position in the cement block 35 as the cement hardens. The sleeves, 34*c* and 34*d* prevent chafing or shredding of the handle as it is used to carry the weight 33. A second embodiment of the weight is shown as a weight 133. Here the weight 133 consists of a container 133 having an opening 133*a* into an inner cavity 133*b*. The container 13 may be of any suitable material such as plastic. Sand, water or other substance of weight may be inserted into the inner cavity 133 to make the weight heavier. It is of course understood that other suitable weights may be utilized or alternately the pan 133 and weight 33 or 133 be combined into a single one piece unit. The pan 31 has two downwardly extending flanges 31*b*. In FIG. 2, only one of the downwardly extending flanges 31*b* are shown. A similar flange is provided on the opposite side of the pan 31. The two flanges 31*b* provides for legs upon which the pan 31 rests. A cover of suitable material, such as plastic, may be inserted over the flanges 31*b* to protect the surface on which the pan 31 sits. Cooperatively connected to the pan 31 is an insertion member 31*c*. The insertion member is sized to be inserted into the second end 16*b* of the leg 16 and may be of any suitable material such as ¾ inch square tubing, 18 inches in length, of which 4 inches protrude past the pan 31, the rest being under the pan 31. The insertion member 31c may be cooperatively connected by any means well known in the art, such as welding. A loop 31*d* is welded to the top of the insertion member 31*c*.

An extension member 20 has a bottom end 20*a* and a top end 20*b*. The extension member 20 is cooperatively connected to the second end 15*b* of the riser 15 and telescopes in to the riser 15 for adjusting to different heights. The extension member 20 is made of ¾ inch square tubing having a length of 51 inches. The outer dimension of the extension member 20 is sized to slide inside of the riser 15 and thereby telescope the stand 10 and thereby adjust the overall height. An end cap 37 is placed on the top end of the extension 20. An inwardly extending extension loop 22 is cooperatively connected on one side of the extension 20, adjacent the top end 20*b*. On the opposite side of the top end 20*b* is cooperatively connected a chain loop 23. An adjusting plate 21 has an inner opening 21*b* sized to allow the extension member 20 to slide through. The adjusting plate 21 has an upwardly extending tongue section 21*a* which extends into the inner opening 21*b* and is sized so that it may be inserted through the holes 20*c*, *d* and *e*. A key slot 24 is formed in the adjusting plate 21. The key slot 24 includes a larger opening 24*b* having a slot 24*a* extending toward the inside edge of the adjusting plate 21. Further, on the outer edge of the adjusting plate 21, a outwardly, downward extending chain connecting flange is cooperatively connected. The flange 21*c* forms an angle a with the adjusting plate 21 of from 90° to 135°.

Figure 3:
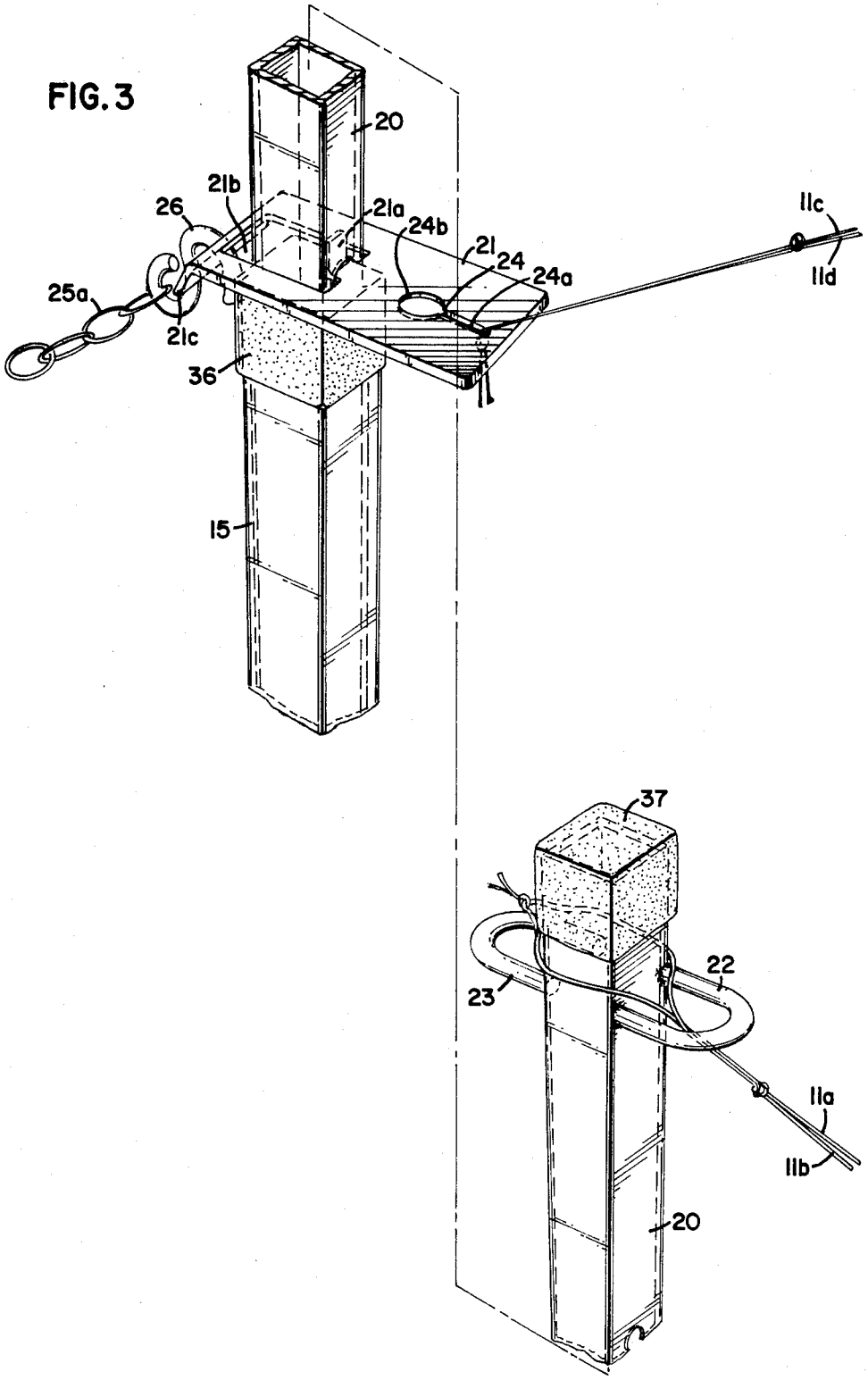
FIG. 3 is an enlarged exploded perspective view of portions of the riser and extension member of the portable net stand shown in FIG. 1.

The individual components of the net stand 10 are easily assembled and disassembled, thereby allowing for ease of transportation. In operation, the foot member 12 is first placed on the ground or floor. If the net stand 10 is to be used outside, the foot member 12 will be in the second position, as shown in FIG. 1. If the stand 10 is to be used inside, the foot member 12 will be in a first position, as shown in FIG. 2. Assuming the stand 10 is to be set up in the first position, the first end 16*a* of the leg 16 is inserted over the second stub 14. The cap 36 is in place before the leg 16 is inserted, thereby providing for a good fit between the stub 14 and the leg 16. The insertion member 31 is then slid through the cap 36 into the second end 16*b* of the leg 16. The first end 15*a* of the riser 15, with a cap 36, is inserted over the first stub 13. The holes 15*c–e* are facing inward, toward the net 11. The inner opening 21*b* of the adjusting plate 21 is placed onto the extension member 20. The bottom end 20*a* of the extension member is then inserted into the second end 15*b* of the riser 15. The key slot 24 is positioned toward the net. The two top strings 11*a* and 11*b* of the net 11 are tied into a series of knots approximately 4 inches apart. As shown in FIG. 3, the top strings 11*a* and 11*b* are slipped underneath the extension loop 22 and over the top end 20*b* of the extension member 20. The loop 22 maintains the height of the strings 11*a* and 11*b* at a constant height by preventing slippage. The extension 20 is then raised to the desired height and the tongue 21*a* of the adjusting plate 21 is placed into the appropriate hole of the extension 20 to give the desired height. A first chain 25 having an S-hook 26 at its first end 25*a* and another S-hook 27 at its second end 25*b* is attached to the net stand. Hook 26 is inserted through the opening 21*d* in the flange 21*c* and hook 27 is inserted through the loop 31*d*. Similarly, the bottom strings 11*c* and 11*d* are tied into a series of knots approximately 4 inches apart. The end of the strings 11*c* and 11*d* are then inserted through the opening 24*b* and the strings are slid through the slot 24*a* and the knots hold the bottom strings in position. Similarly, the other end of the net is fastened to a second net stand 10. The foot member 12 is moved away from the net until the pan 31 floats approximately 6 inches above the surface. The weight 33 or 133 is then placed on the pan 31 which brings the net stand 10 down level and tightens the net 11. Before the weight is placed on the pan, the stand tends to tip sideways. After the weight is applied the stand becomes quite stable. The bottom strings 11*c* and 11*d* may then be adjusted to the proper length by slipping the knot, at the appropriate length, through the opening 24*b* into the key slot 24. For the dimensions given previously in this description, the tongue 21*a* is inserted in hole 20*c* for mens volleyball, 20*d* for women's volleyball and 20*e* for badminton. For badminton, eye bolts (not shown) are inserted in holes 15*c* and 15*e*. The net stand 10 may also be used for lawn tennis. However, the extension member 20 is then not needed. The chains are simply hooked to the top of the riser and eye bolts are inserted through holes 15*e* and 15*a*. The eye bolts are necessary for both lawn tennis and badminton to attach the strings 11*a–d* of the net 11 to the stand.

By having angle A between 90° and 135°, the tension provided by the chain 25 tends to hold the adjusting plate 21 level, thereby riding level on the cap 36. This provides for even wear on the cap 36. At other angles, the adjusting plate 21 would tend to ride at an angle, thereby unevenly wearing on cap 36. An auxiliary chain 28 may also be utilized when a heavy duty net or if a weight 33 of over 40 pounds is used. The auxiliary chain 28 has a first end 28*a* with an S-hook 29 and a second end 28*b* b with an S-hook 30. The S-hook 29 is attached to the chain loop 23 and the S-hook 30 is attached to one of the links of the chain 25.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternate modifications and variations of the present invention which follows in the spirit and broad scope of the appended claims are included.

I claim:

1. A free standing sport net stand for supporting a net comprising:

(a) a foot member having first and second stub members cooperatively connected thereto, said stub members generally perpendicular to said foot member and said first stub member generally perpendicular to said second stub member, wherein when in a first position said first stub member extends generally upward and said second stub member extends generally outward and when in a second position said first stub member extends generally outward and said second stub member extends generally upward;

(b) a generally upwardly extending riser having first and second ends, said first end cooperatively connected to one of said stub members, said riser having holes formed therein, whereby the net may be secured to said riser for playing a first sport;

(c) a leg member having first and second ends, said first end cooperatively connected to said other of said stub members;

(d) a weight assembly cooperatively connected to said second end of said leg member; and (e) said foot member having claw members attached thereto, said claw members extending generally downward when said foot member is in the second position, thereby stabilizing said stand when outside and when said foot member is in the first position said claws extend inward for inside use.

2. The stand of claim 1, further comprising:

(a) an extension member having a top end and a bottom end, said bottom end cooperatively connected to said second end of said riser and telescoping on said riser, said extension member having holes formed therein for securing the net at various levels; and (b) an adjusting plate having an inner opening for sliding on the outside of said extension member, said plate having an upwardly extending tongue for insertion into one of said holes of said extension member, thereby locking said extension member in place at a set height.

3. The stand of claim 2, wherein said plate further comprises an outwardly, downwardly extending chain connection flange, said flange forming an angle with said plate of from 90° to 135°.

4. The stand of claim 3, further comprising said plate having a keyhole adjusting slot, whereby a bottom string of the net may be secured without tying.

5. The stand of claim 3, further comprising a first chain having first and second ends for cooperatively connecting said connection flange to said weight assembly.

6. The stand of claim 5, further comprising an inwardly positioned extension loop cooperatively connected to said top end of said extension member, whereby a top string of the net may be secured without tying.

7. The stand of claim 1, wherein said weight assembly comprises:

(a) a pan having upwardly extending flanges; and (b) a removable weight sized to fit in said pan, wherein the stand is unstable in a sideways motion until said weight is applied.

8. The stand of claim 7, further comprising said pan having downwardly extending flanges to form legs for resting on flat surfaces and said pan having an insertion member for insertion into said second end of said leg and said pan having a loop on said insertion member.

9. The stand of claim 8, further comprising caps inserted on said ends of said riser and said ends of said leg, said caps having a face surface having at least one slit for allowing insertion therethrough.

10. The stand of claim 9, wherein said removable weight comprises a container having an opening into an inner cavity, said cavity adapted to be filled with a substance to make said weight heavier.

11. The stand of claim 9, wherein said weight comprises a block of cement having a handle, said handle having a first and second end which are embedded in said cement.

12. The stand of claim 11, further comprising sleeve members surrounding said first and second ends of said handle where they enter said cement, thereby preventing chafing and shredding of said handle.

13. The stand of claim 5, further comprising an auxiliary chain having a first end cooperatively connected adjacent said send end of said extension and a second end cooperatively connected to said first chain between said first end and said second end of said chain.

14. A free standing sport net for support a net comprising:

(a) a foot member having first and second stub members cooperatively connected thereto, said stub members generally perpendicular to said foot member and said first stub member generally perpendicular to said second stub member, wherein when in a first position said first stub member extends generally upward and said second stub member extends generally outward and when in a second position said first stub member extends generally outward and said second stub member extends generally upward;

(b) a generally upwardly extending riser having first and second ends, said first end cooperatively connected to one of said stub members, said riser having holes formed therein, whereby the net may be secured to said riser for playing a first sport;

(c) a leg member having first and second ends, said first end cooperatively connected to said other of said stub members;

(d) a weight assembly cooperatively connected to said second end of said leg member;

(e) said foot member having claw members attached thereto, said claw members extending generally downward when said foot member is in the second position, thereby stabilizing said stand when outside and when said foot member is in the first position said claws extend inward for inside use;

(f) an extension member having a top end and a bottom end, said bottom end cooperatively connected to said second end of said riser and telescoping on said riser, said extension member having holes formed therein for securing the net at various levels;

(g) an adjusting plate having an inner opening for sliding on the outside of said extension member, said plate having an upwardly extending tongue for insertion into one of said holes of said extension member, thereby locking said extension member in place at a set height;

(h) said plate further comprises an outwardly, downward extending chain connection flange, said flange forming an angle with said plate of from 90° to 135°;

(i) said plate having a keyhole adjusting slot, whereby a bottom string of the net may be secured without tying;

(j) an inwardly positioned extension loop cooperatively connected to said top end of said extension member, whereby a top string of the net may be secured without tying;

(k) caps inserted on said ends of said riser and said ends of said leg, said caps having a face surface having at least one slit for allowing insertion therethrough; and (l) an auxiliary chain having a first end cooperatively connected adjacent said send end of said extension and a second end cooperatively connected to said first chain between said first end and said second end of said chain.

15. A free standing portable net stand and net comprising:

(a) a foot member having first and second stub members cooperatively connected thereto, said stub members generally perpendicular to said foot member and said first stub member generally perpendicular to said second stub member, wherein when in a first position said first stub member extends generally upward and said second stub member extends generally outward and when in a second position said first stub member extends generally outward and said second stub member extends generally upward;

(b) a generally upwardly extending riser having first and second ends, said first end cooperatively connected to one of said stub members, said riser having holes formed therein, whereby the net may be secured to said riser for playing a first sport;

(c) a leg member having first and second ends, said first end cooperatively connected to said other of said stub members;

(d) a weight assembly cooperatively connected to said second end of said leg member;

(e) said foot member having claw members attached thereto, said claw members extending generally downward when said foot member is in the second position, thereby stabilizing said stand when outside and when said foot member is in the first position said claws extend inward for inside use; and (f) a net cooperatively connected to said stand.

16. The stand and net of claim 15, further comprising:

(a) an extension member having a top end and a bottom end, said bottom end cooperatively connected to said second end of said riser and telescoping on said riser, said extension member having holes formed therein for securing said net at various levels; and (b) an adjusting plate having an inner opening for sliding on the outside of said extension member, said plate having an upwardly extending tongue for insertion into one of said holes of said extension member, thereby locking said extension member in place at a set height.

17. The stand and net of claim 16, wherein said plate further comprises an outwardly, downward extending chain connection flange, said flange forming an angle with said plate of from 90° to 135°.

18. The stand and net of claim 17, further comprising said plate having a keyhole adjusting slot, whereby a bottom string of the net may be secured without tying.

19. The stand and net of claim 17, further comprising a first chain having first and second ends for cooperatively connecting said connection flange to said weight assembly.

20. The stand and net of claim 15, wherein said weight assembly comprises:

(a) a pan having upwardly extending flanges; and (b) a removable weight sized to fit in said pan.

21. The stand and net of claim 17, further comprising caps inserted on said ends of said riser and said ends of said leg, said caps having a face surface having at least one slit for allowing insertion therethrough.

22. The stand and net of claim 19, further comprising an auxiliary chain having a first end cooperatively connected adjacent said send end of said extension and a second end cooperatively connected to said first chain between said first end and said second end of said chain.

* * * * *